United States Patent [19]

Marchina

[11] Patent Number: 5,004,214

[45] Date of Patent: Apr. 2, 1991

[54] DEVICE FOR ADJUSTING THE BACKREST AND/OR THE SEAT OF CHAIRS

[75] Inventor: Luciano Marchina, Ospitaletto, Italy

[73] Assignee: Mara S.R.L., Italy

[21] Appl. No.: 406,759

[22] Filed: Sep. 13, 1989

[30] Foreign Application Priority Data

Sep. 15, 1988 [IT] Italy ..... 21878/88[U]

[51] Int. Cl.[5] ..... F16F 5/00

[52] U.S. Cl. ..... 267/64.12; 188/300; 248/161; 248/631; 267/131; 297/300

[58] Field of Search ..... 267/117, 64.22, 113, 267/64.12, 131, 64.11, 64.28, 120; 188/300; 248/161, 162.1, 631; 297/300, 345, 355, 304, DIG. 3; 16/84, 66

[56] References Cited

U.S. PATENT DOCUMENTS

| | | | |
|---|---|---|---|
| 3,790,119 | 2/1974 | Bauer | 248/631 X |
| 3,979,109 | 9/1976 | Ishida | 267/64.12 X |
| 4,108,416 | 8/1978 | Nagase et al. | 267/131 X |
| 4,415,135 | 11/1983 | French | 248/161 |
| 4,662,680 | 5/1987 | Dauphin | 297/300 |
| 4,756,496 | 7/1988 | Hosan et al. | 248/631 X |

FOREIGN PATENT DOCUMENTS

| | | | |
|---|---|---|---|
| 2026204 | 12/1971 | Fed. Rep. of Germany | 248/161 |
| 8303958 | 11/1983 | World Int. Prop. O. | 248/161 |

*Primary Examiner*—Douglas C. Butler
*Attorney, Agent, or Firm*—Steinberg & Raskin

[57] ABSTRACT

A device for adjusting the inclination of the backrest and/or seat of chairs, particularly office chairs, has a gas spring, a head member connectable to the gas spring, an L-shaped lever member pivotally connected to the head member and including a first arm, a second arm, and a rod acting on the first arm so as to cause rotation of the L-shaped member and consequent pushing action of the second arm on the driving shaft of the valve of the gas spring.

3 Claims, 3 Drawing Sheets

DEVICE FOR ADJUSTING THE BACKREST AND/OR THE SEAT OF CHAIRS

BACKGROUND OF THE INVENTION

Several type of devices are known for controlling the gas spring associated with a kinematic system for adjusting the inclination of the backrest and/or the seat of chairs or armchairs in general, in particular for office chairs.

These known devices, however, have all the serious drawbacks of requires a certain effort by the user for adjusting the device particularly for causing the rotation of a cam which acts by friction on the shaft of the gas spring.

SUMMARY OF THE INVENTION

An object of the present invention is to provide an improved device for adjusting the inclination of the backrest and/or the seat of chairs in general, particularly for office chairs, the device being of the type comprising a gas spring, and the device being so conceived to substantially reduce the effort for controlling the opening and closing of the gas spring valve shaft.

This and other objects of the invention will become evident to those skilled in the art by the reading of the following description.

The improved device for adjusting the inclination of the backrest and/or the seat of chairs in general, and particularly of office chairs, is of the type comprising a gas spring and is essentially characterized in that it comprises a head connectable to said gas spring, a member forming substantially an L-shaped lever pivoted to the head and comprising a first and a second arm and a rod acting on the first arm so as to cause rotation of the L-shaped member and consequent pushing action of second arm on the driving shaft of the valve of said gas spring in the direction of causing the opening of said valve.

DESCRIPTION OF THE PREFERRED EMBODIMENT

Figure 1:
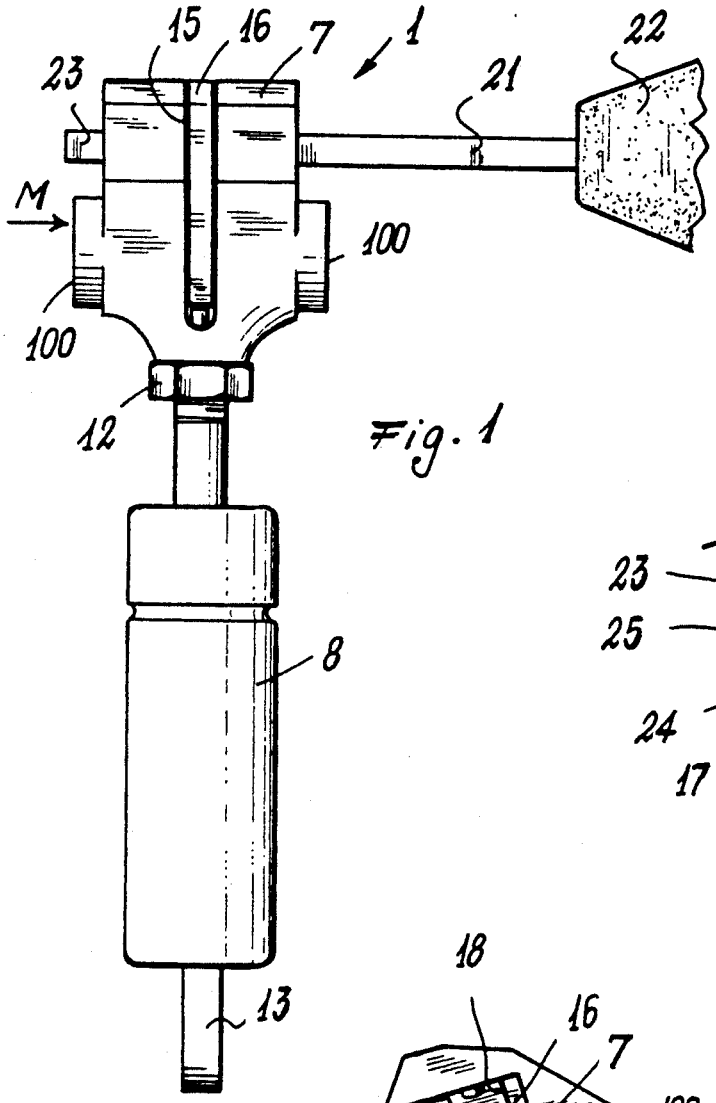
FIG. 1 is a bottom view from the bottom of the device in its entirety.

With particular reference to FIGS. 1-5, the device 1 comprises a head member 7 onto which a conventional gas spring 8 is screwed, the inside valve of the gas spring being controlled by a shaft 10 exiting from an extension member 9 of the same gas valve. The affixing of the gas spring 8 to the head 7 is obtained by screwing the extension member 9 into a threaded hole 11 provided on the same head. A nut 12 allows to regulate the threading depth according to projection of shaft 10 from the extension member 9.

In the center of the head 7 there is provided a slot 15 within which a rocker member 16 is pivotable about a pin 17 transversally disposed relative to the slot 16. This rocker member (see in particular FIG. 5) is flat faced and is provided with a first edge 18 and with a second edge 19, both forming an L-shaped lever arm.

On a pin 20 (FIG. 4), orthogonal to pin 17, a rod 21 is pivoted, said rod having a handgrip 22 at one end, the opposite end 23 of the rod exiting from an opening 24 (FIG. 2 and 3) provided on one side of the head 7.

The opening 24 is partially defined by element a step 25 the function of which will be understood from the following.

Figure 6:
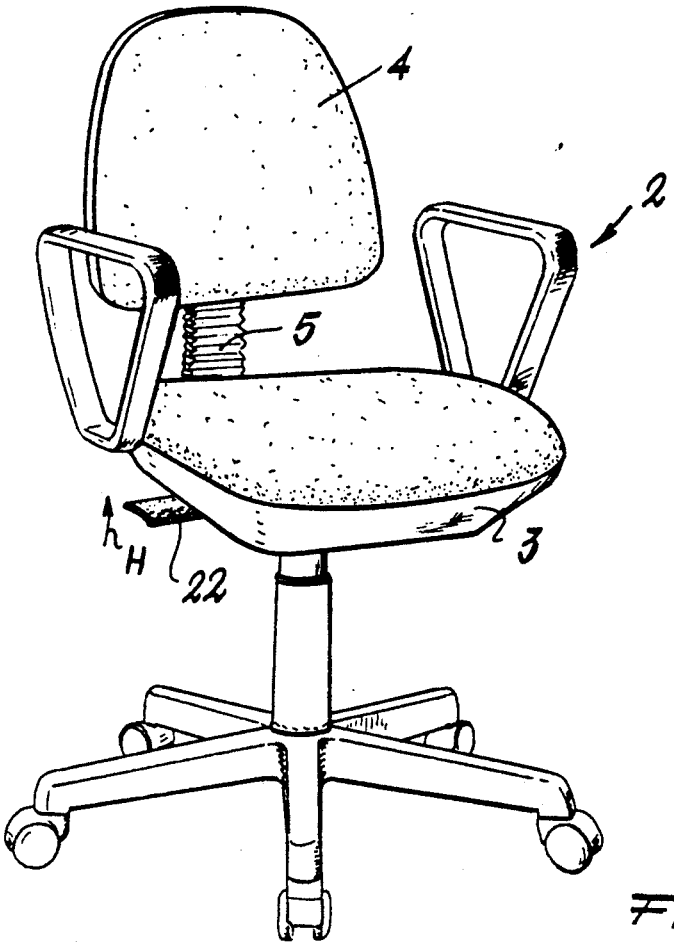
FIG. 6 shows an armchair for office use including the device according to the invention.
Figure 7:
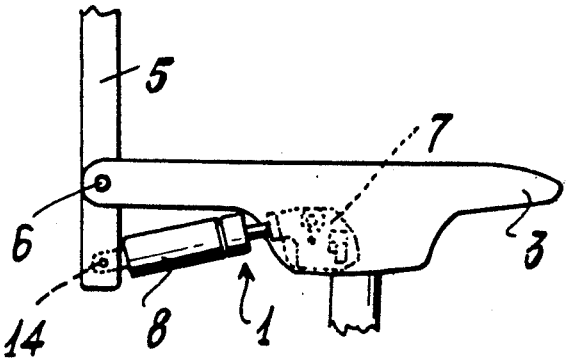
FIG. 7 schematically shows the pivoted connection of the backrest support to the seat and the mounting of the device of the invention for adjusting the inclination of the backrest only.
Figure 8:
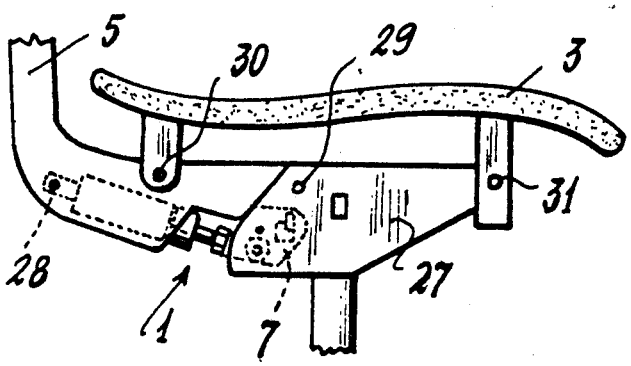
FIG. 8 schematically shows the rigid connection of the backrest support to the seat and the mounting of the device of the invention for the joint adjustment of the backrest and seat.

With particular reference to FIGS. 6, 7 and 8, the device 1 can be mounted on any type of chair needing, for any reason, the adjustment of the inclination of the backrest and/or the seat, for example an office armchair, generally indicated by 2, having a padded seat 3 and a backrest 4, also padded, the support 5 of which, as schematically shown in FIG. 7, is pivotable about joint 6 to the seat 3. In this case (FIG. 7) the head 7 of the device 1 is connected to the seat 3 and the tab 13 of the gas spring 8 is pivotally connected at joint 14 on the lower part of the support 5.

In the case of FIG. 8, i.e. in the case of the joint adjustment of the backrest 4 and seat 3, the head 7 of the device 1 is connected to a fixed part 27 of the chair and the tab 13 of the gas spring 8 is pivotable about joint 28 on the backrest support 5, which support is pivoted in 29 to the fixed part 27, while the seat 3 is pivotable about joint 30 on the support 5 and about joint 31 on the same fixed part 27.

Figure 2:
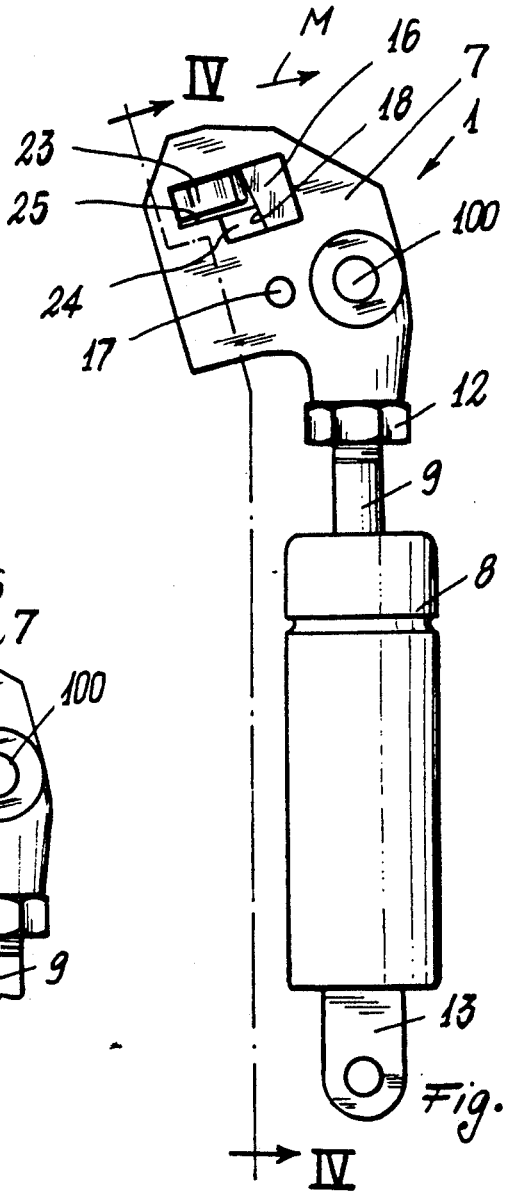
FIG. 2 is a side view of the device (arrow M, in FIG. 1), in a nonworking position.
Figure 3:
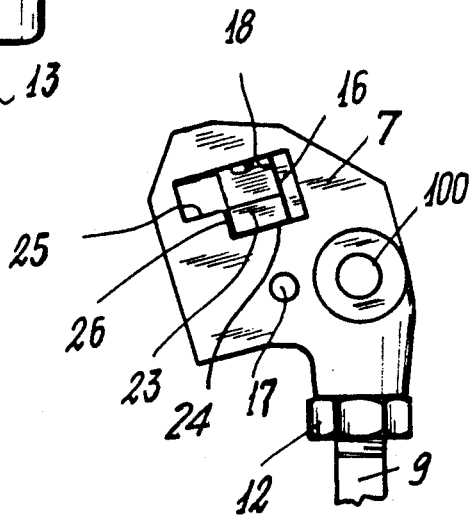
FIG. 3 is a view of part of the device shown in FIG. 2, but in a continuous working position.
Figure 4:
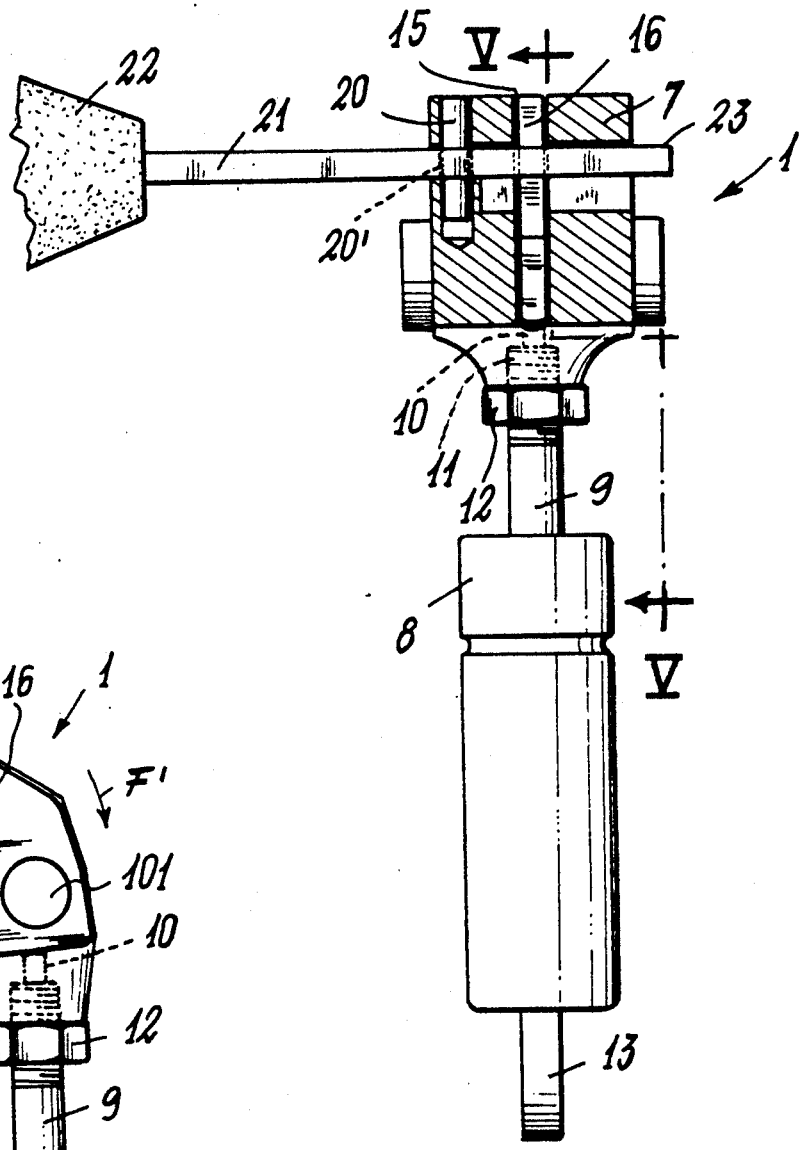
FIG. 4 is a partially sectional view taken along lines IV—IV of FIG. 2.
Figure 5:
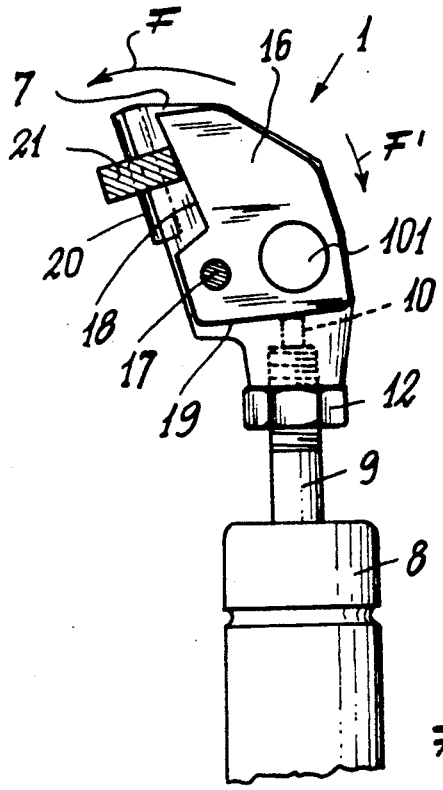
FIG. 5 is a partially sectional view and a partial section taken along lines V—V of FIG. 4.

For action of the shaft 10, due to the inside pressure of the gas spring 8, against the second edge 19 of the rocker member 16, the latter tends to rotate in the direction of arrow F (FIG. 5) and to push, therefore, with its first edge 18 against the rod 21 which, when in the rest position, will dispose itself and will maintain the position shown in FIG. 2, i.e. engaging the step 25 partially defining the opening 24.

In this position the valve of the gas spring 8 is closed and the whole system locked.

To change the inclination of the backrest 4 and/or of the seat 3, the user while sitting, shifts upwardly (arrow H, FIG. 6) the handgrip 22 and causes the shifting (arrow M, FIG. 2) of the rod 21 which will act on the first edge 18 of the rocker member 16 by causing it to rotate about the pin 17 (arrow F', FIG. 5) so as to act with its second edge 19 onto the shaft 10 lowering it to open the valve of the gas spring 8. The user, by pushing onto the backrest 4, can change at will the inclination of the latter, eventually jointly with the seat 3, and the whole system will lock in the desired position when the handgrip is released.

Should one desire to maintain the device 1 locked so as to allow the backrest 4 and/or the seat 3 to adapt itself to the various positions which the user wishes, it will be enough to raise (arrow H) the handgrip 22 and to swing the rod 21 until the end 23 engages the lower part 26 of the opening 24 (FIG. 3): in this position the rod 21 is locked and the rocker member 16 with its second edge 19 maintains the shaft 10 in a lowered position and, therefore, the valve of the gas spring in an opened position. The shifting of the rod 21 is allowed by the presence of an ample clearance between the pin 20 and the related hole 20' (FIG. 4) in the rod.

As stated heretofore, the head 7 is mounted below the seat 3 by means of bolts or screws and in the rocker member 16, in this case, there is provided a large hole 101 (FIG. 5) which allows the passage of these bolts or screws without hindering the shifting (arrows F and F') of the rocker member.

The foregoing fully reveals that the proposed solution offers the remarkable advantage of allowing the operation of the shaft 10 of the gas spring valve with a minimum effort thanks to the double multiplication of the force due to (a) the possibility of selecting a suitable ratio between the length of the two edges 18 and 19 and (b) the possibility of selecting a suitable length of the rod 21 so as to apply the force (arrow H) as far as possible from the fulcrum (20).

What I claim is:

1. A device for adjusting the inclination of the backrest and seat of chairs, said device comprising:

a gas spring comprising an inside valve member, a valve extension member integral thereto, and a valve drive shaft extending from said valve extension member, said gas spring connected at one end to a support for said backrest;

a head comprising a first body portion having a threaded hole therethrough, said valve extension member being threadable into said hole to operatively connect said head to the other end of said gas spring, and said head having a second body portion integral with and adjoining said first body portion, said second body portion having a slot therethrough, said head being connected to said chair seat;

a first pin disposed in said head, said first pin oriented substantially transversely to said slot and said first pin passing through said slot;

a rocker member disposed in said slot and pivotable about said first pin, said rocker member having a first edge along a front surface transverse to said slot and a second edge along a bottom surface transverse to said slot;

a second pin disposed in said head and oriented substantially parallel to said slot and substantially transverse to said first pin;

a rod disposed to be pivotable about said second pin;

a handgrip connected to one end of said rod such that upward movement of said handgrip causes said rod to contact said first edge of said rocker member and to pivot said rocker member about said first pin, causing said second edge of said rocker member to impinge upon said valve drive shaft, thus lowering said shaft to open said inside valve member of said gas spring whereupon said backrest and said seat can be manually repositioned.

2. The device of claim 1, further comprising said head having a opening through which the end of said rod opposite said handgrip passes, said head having a surface defining said opening such that said handgrip can be moved such that said rod engages said surface to assume a locked position with said inside valve member of said gas spring in an open position whereupon said backrest and said seat can be manually repositioned.

3. The device of claim 2, further comprising said rocker member having a hole therethrough large enough to allow bolts and nuts for attaching said head to said seat to pass through said hole.

* * * * *